United States Patent [19]

Kohola et al.

[11] Patent Number: 4,737,844

[45] Date of Patent: Apr. 12, 1988

[54] METHOD FOR THE GENERATION OF REAL-TIME CONTROL PARAMETERS FOR SMOKE-GENERATING COMBUSTION PROCESSES BY MEANS OF A VIDEO CAMERA

[75] Inventors: Pekka Kohola, Espoo; Reijo Lilja, Helsinki; Martin Ollus, Espoo; Petri Tanskanen, Helsinki; Raimo Sutinen, Oulu, all of Finland

[73] Assignee: Oy Nokia AB, Helsinki, Finland

[21] Appl. No.: 7,186

[22] Filed: Jan. 27, 1987

[30] Foreign Application Priority Data

Jan. 27, 1986 [FI] Finland ..... 860380

[51] Int. Cl.[4] ..... H04N 7/18

[52] U.S. Cl. ..... 358/100; 358/93

[58] Field of Search ..... 358/100, 93, 108, 107, 358/160, 133, 37, 166; 382/52

[56] References Cited

U.S. PATENT DOCUMENTS 4,520,390 5/1985 Paredes et al. ..... 358/100 X 4,628,465 12/1986 Ito et al. ..... 358/100 X 4,641,257 2/1987 Ayata ..... 358/100 X

*Primary Examiner*—Howard W. Britton

*Assistant Examiner*—Victor R. Kostak

*Attorney, Agent, or Firm*—Birch, Stewart, Kolasch & Birch

[57] ABSTRACT

A method for generating real-time control parameters by a video camera for smoke-generating combustion reactions is disclosed. In accordance with the method, a video camera is used for obtaining a video signal, which is digitized and filtered temporally and spatially. The digitized video signal is divided on the basis of its signal level distribution into signal subareas to reduce the quantity of processed information. The picture elements belonging to the same subarea are combined into contiguous image areas representing a certain signal level, the subareas are combined into an integrated image, subsequent images are averaged to eliminate random disturbance, and the averaged image is displayed on a display device. This method facilitates the real-time monitoring of a combustion process.

6 Claims, 7 Drawing Sheets

PRIOR ART

METHOD FOR THE GENERATION OF REAL-TIME CONTROL PARAMETERS FOR SMOKE-GENERATING COMBUSTION PROCESSES BY MEANS OF A VIDEO CAMERA

The present invention relates to a method in accordance with the preamble of claim 1 for the generation of real-time control parameters by means of a video camera signal for the control of smoke-generating combustion processes.

DESCRIPTION OF THE BACKGROUND ART

In stoker boilers the combustion process is controlled by means of a direct camera-to-monitor chain. A black-and-white video camera, especially developed for the monitoring of combustion processes, is mounted in the wall of the fire box. A special construction video camera for this application is often called a fire-box monitoring camera. The unprocessed video output signal from the video camera is connected to a monitor. Then, based on the video image, the required control procedures of the stoker boiler, such as the control of a hydraulically driven stoker or quantity of combustion air, are effected. The goal of video signal use has been to define from the video image the location of the flame front which is the principal control parameter, as well as to locate possible craters in the fuel bed which cause an uneven air flow.

In soda recovery boilers the combustion process is monitored by means of a video camera but principal information is obtained via the air feed openings.

A disadvantage of the prior art technique is that the image obtained by using the direct video connection is rather undefined due to the random movement of the flames. Also, the generation of smoke disturbs the image. Consequently, the control information obtained from the video image is mostly approximative and does not provide means for an efficient control of the combustion process. In soda recovery boilers the video image gives relatively little information because most of the radiation emitted by the combustion process does not effectively fall within the range of visible light. Monitoring the process via the air feed openings is awkward and leaves obscured areas in the visible field.

SUMMARY OF THE INVENTION

The present invention aims to overcome the disadvantages of the aforementioned technique and to achieve a completely novel method for generating real-time control parameters by means of a video camera for smoke-generating combustion reactions.

The invention is based on monitoring the combustion process with a video camera whose signal is digitized, filtered appropriately, and formatted on the basis of the distribution of the digitized signal, into a histogram table for image processing in which the table is processed into an image from which the location of the flame front is appropriately identified for process control on the basis of the averaging of video images.

More specifically, the method in accordance with the invention is characterized by a method for generating real-time control parameters by means of a video camera for smoke-generating combustion processes with the method based on generating a video signal by means of a video camera, digitizing the video signal, and filtering the digitized video signal temporally and spatially, characterized by the following, dividing the digitized video signal on the basis of its signal level distribution onto signal subareas in order to reduce the quantity of information to be handled, combining the picture elements belonging to the same subarea into contiguous image areas, each of which corresponds to a certain signal level, combining the subareas into an integrated image, averaging the subsequent images so as to eliminate the effect of random disturbances, and displaying the averaged image on a display device.

The invention provides appreciable benefits.

In its practical implementation, the method in accordance with the invention provides an image in the form of a two-dimensional table indicating the short-term average value of the temperature distribution of the fuel bed, which facilitates the easy localization of the flame front location, size, and form, from the image. Because of the fast computation method, the image processing takes only a few seconds, which allows a real-time control of the combustion process. Images obtained by use of the method can be compared to an optimum condition, which simplifies the control task. A time related comparison of subsequent averaged images make it possible to anticipate the spreading of the flame front and to estimate the stability of the combustion process.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the present invention will be examined in detail by means of exemplifying embodiments illustrated in the enclosed drawings which are given by way of illustration only, and thus are not limitative of the present invention, and wherein.

DETAILED DESCRIPTION OF THE PREFERRED EMBODIMENTS

Figure 1:
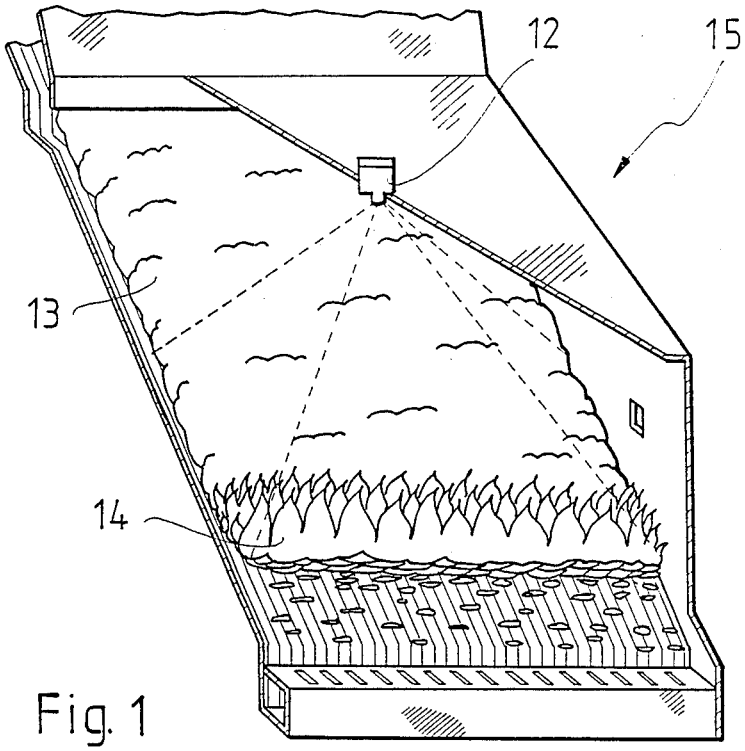
FIG. 1 shows a longitudinal partially cross-sectioned perspective view of a stoker boiler with a fire-box monitoring camera installed therein.
Figure 2:
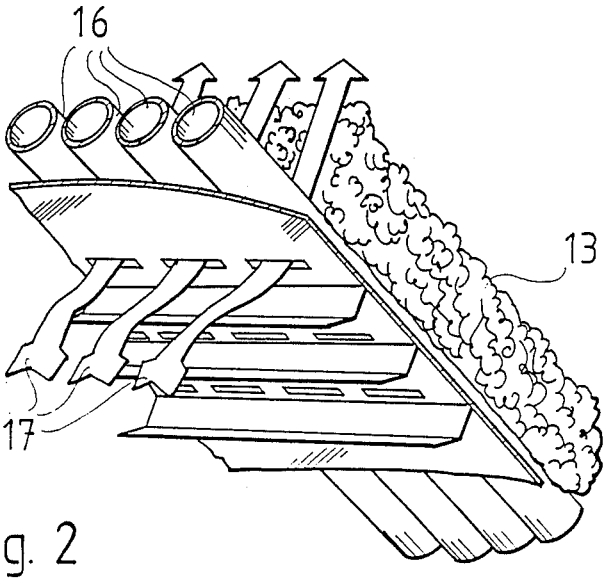
FIG. 2 shows a partially cross-sectioned perspective view of the stoker construction of a stoker boiler.
Figure 3:
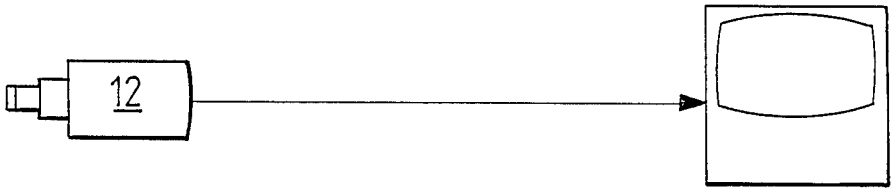
FIG. 3 schematically shows conventional monitoring equipment for the combustion process.

FIG. 1 shows the combustion process of a stroker boiler 15 operating very close to the optimum. A fuel bed 13 is burning with a continuous firing front 14 at the lower end of a boiler stoker 16. Omitted from FIG. 1 are the undesirable craters which may be created in the fuel bed 13 if firing occurs elsewhere other than at the lower end of the bed. As shown in FIG. 2, the craters cause an airflow 17 which enters from below through the stoker, with the flow concentrating in the craters, thus inhibiting the controlled combustion air flow through the fuel bed 13 and further causing an uneven humidity profile percentage in the fuel bed 13.

Figure 4:
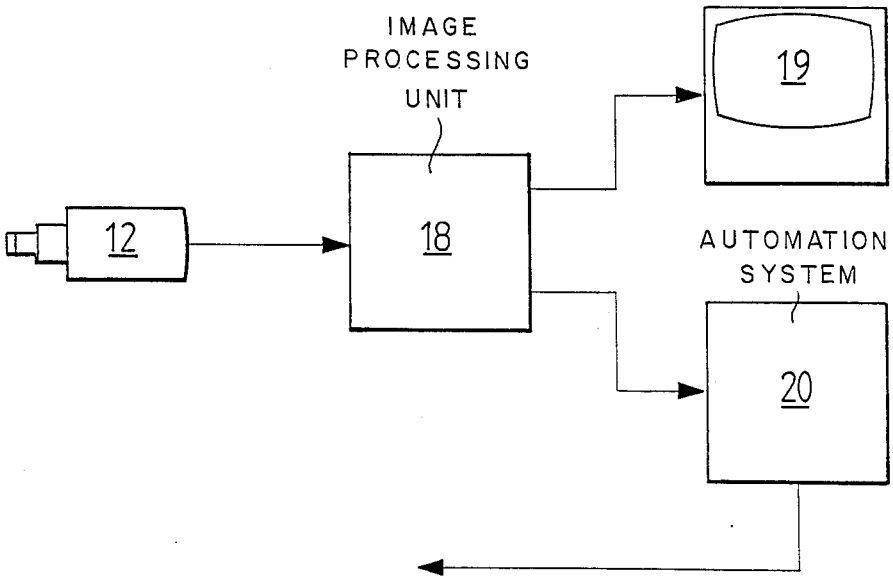
FIG. 4 schematically shows monitoring equipment for the combustion process in accordance with the present invention.

FIG. 4 shows in a simplified form the combustion process monitoring members and their interconnections associated with the method in accordance with the present invention. A fire-box monitoring camera 12 provides a video output signal to an image processing unit 18, which is connected to a color monitor 19 and an automation system 20 of the stroker boiler 15. Furthermore, the automation system 20 is connected via a control line to the control system of the boiler 15 and the color monitor 19.

Figure 5:
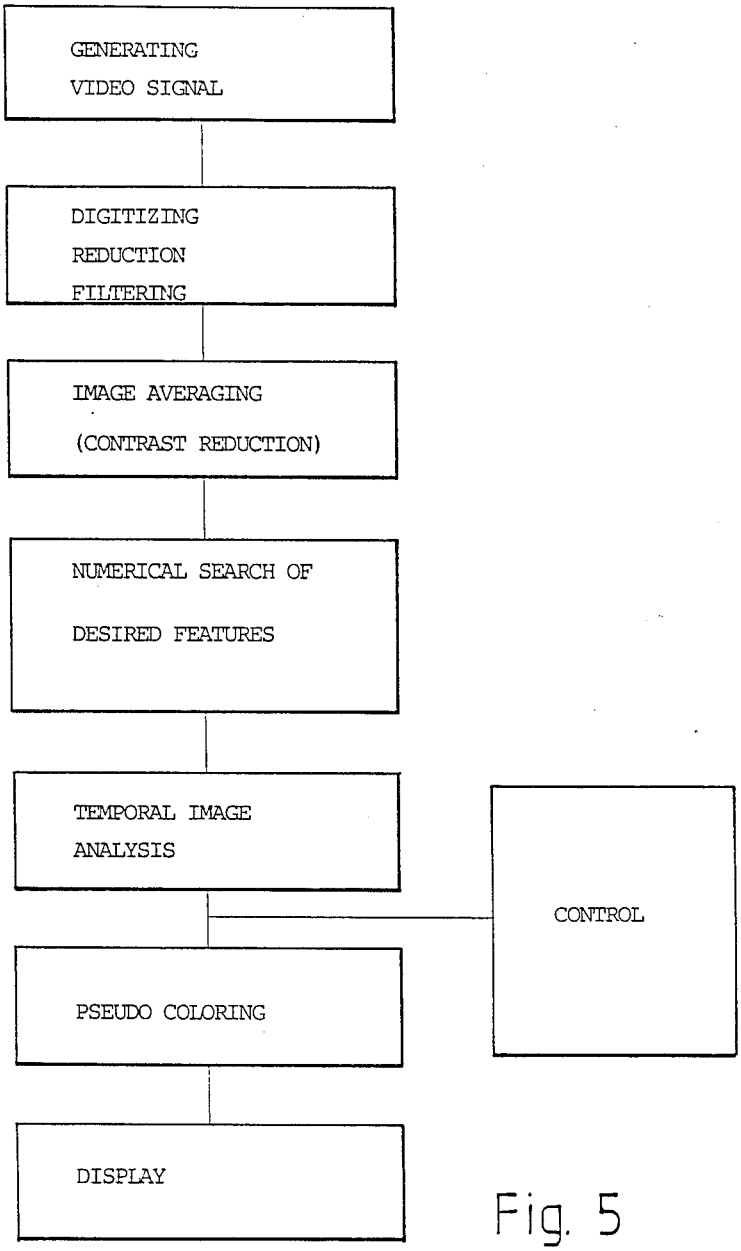
FIG. 5 schematically shows a block diagram of the method in accordance with the present invention.

FIG. 5 shows in detail the main principles of the method in accordance with the present invention. The first block represents the fire-box monitoring camera 12 from which the video signal is routed, to the second block in which the digitization of the image is performed by quantization of the analog video signal to discrete levels; transferred to an image memory, and finally, information is read from the image memory into the working memory of the computer with an appropriate reduction of image information. Information can be compacted by omitting every other picture element and every other scan line without losing the efficiency of the method. In the applied method, this means a reduction of resolution from 256×256 pixels to 128×128 pixels. The second block also performs a filtering operation in which the comparison of subsequent picture elements is used for reducing large intensity differentials between subsequent picture elements, and a temporal filtering operation in which the value of each picture element signal is compared to the temporally preceding value of the same picture element, after which computational methods are applied to reduce large variations in order to attenuate large signal variations caused by sparking and smoke. The third block performs image averaging with contrast reduction of the image signal. This kind of image "make up" can be used for reducing disturbance. In the fourth block, the "made up" information is used for numerically searching for the desired pixel values by means of histogram processing (to be described later) so as to find the picture elements characteristic of combustion areas 1, 2 in this embodiment. Block five performs the image analysis in which the image is compared to previous images and the optimum situation, after which the control operations are performed by block six. Block seven assigns each intensity level an individual color to be displayed in the color monitor 19 of block eight, which serves as the real-time supervisory monitor for the boiler plant operator.

Figure 6:
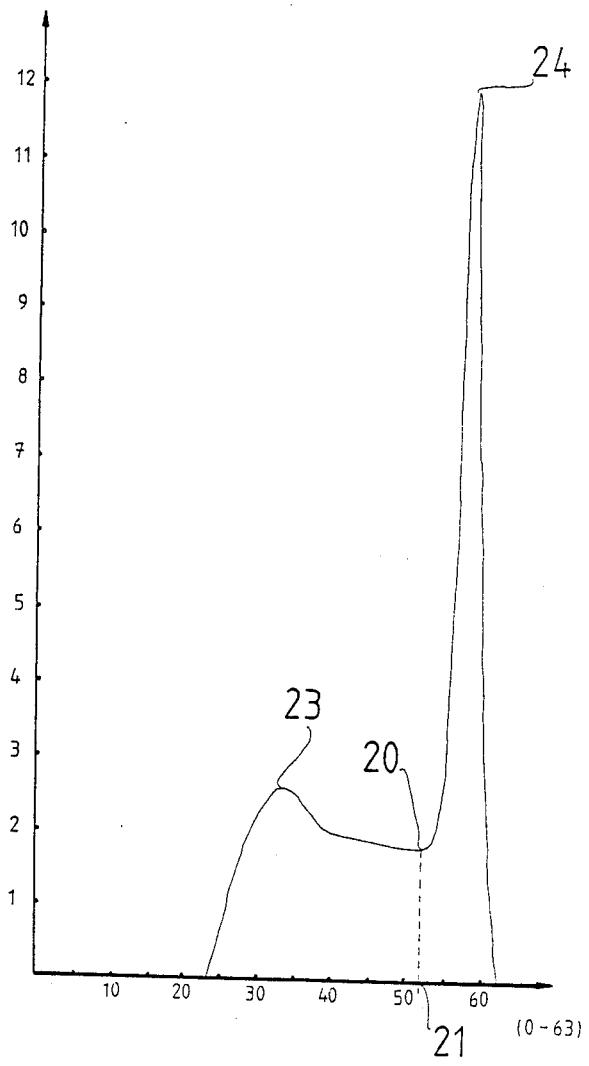
FIG. 6 shows a histogram of the fire-box monitoring camera image when the combustion process is unobstructedly visible.
Figure 7:
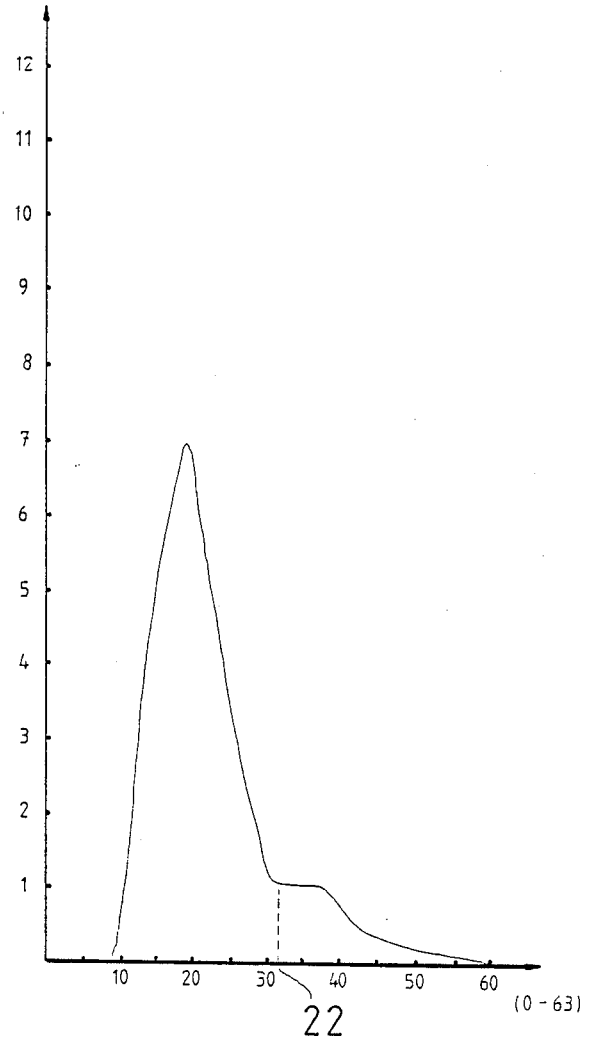
FIG. 7 shows a histogram of the fire-box monitoring camera image when the combustion process is obscured by smoke or steam.

After the video signal has been digitized, filtered and processed in the foregoing manner, areas corresponding to an effective combustion are defined using histograms shown in FIGS. 6 and 7. The definition of intensity levels on the basis of histograms may be performed irregularly for calibration purposes: in practice, however, it has proven necessary to define the intensity levels at regular intervals, for instance, at five minute intervals. The horizontal axis of FIG. 6 illustrates the intensity levels of picture element signals from the camera, which may receive 63 discrete values so that the intensity is increased from the left to the right in the diagram. The vertical axis shows the percentage distribution of picture elements at each intensity level in relationship to the total number of picture elements.

Compressed and averaged on the basis of the histogram, the image is quantized to intensity levels essential to the combustion process. A picture element is assigned to a certain intensity level if its intensity value is equal to or larger than the lower limit defined for the level and smaller than or equal to the upper level defined for the level. The quantization result is shown by means of a bar table in which the points belonging to the same intensity level, and located adjacently in the same row, form a bar. Normally, the bar table is shown on a CRT monitor screen where a horizontal row is represented by a horizontal bar formed from the picture primitives of the CRT display. The bar display format offers an essential reduction of processed information.

On the basis of the bar table, the contiguous areas of the flame image are identified. In this context, a contiguous area is defined as an area having the intensity values of its adjacent picture elements belonging to the same quantization level of intensity and having a closed contour. A contiguous area may also incorporate holes or voids, which are not belonging to the aforementioned intensity level.

FIGS. 6 and 7 illustrate the method in detail. Shown in FIG. 6 is a histogram in which the whole of the firing front 14 is unobscuredly visible. The unobscured combustion is represented in FIG. 6 by such picture elements whose intensity value is larger than an intensity value 21 corresponding to a minimum value 20 of the histogram. In accordance with FIG. 7, combustion zones obscured by smoke or steam are represented by such picture elements whose intensity value is larger than an intensity value 22 or smaller than an intensity value 23 in FIG. 6. The intensity value 22 is defined as an intensity value whose derivative of picture elements in respect to the intensity is largest and which is located to the right from the inflection point located to the right from the peak 23 in FIG. 6. Combustion zones 1 are represented by such contiguous areas which fulfill the aforementioned criteria and are defined and identified by means of their area, point of gravity coordinates of the area, and point-by-point recorded contours of the area. In addition, any possible areas, gravity points and contours of voids inside the area are defined.

Figure 8:
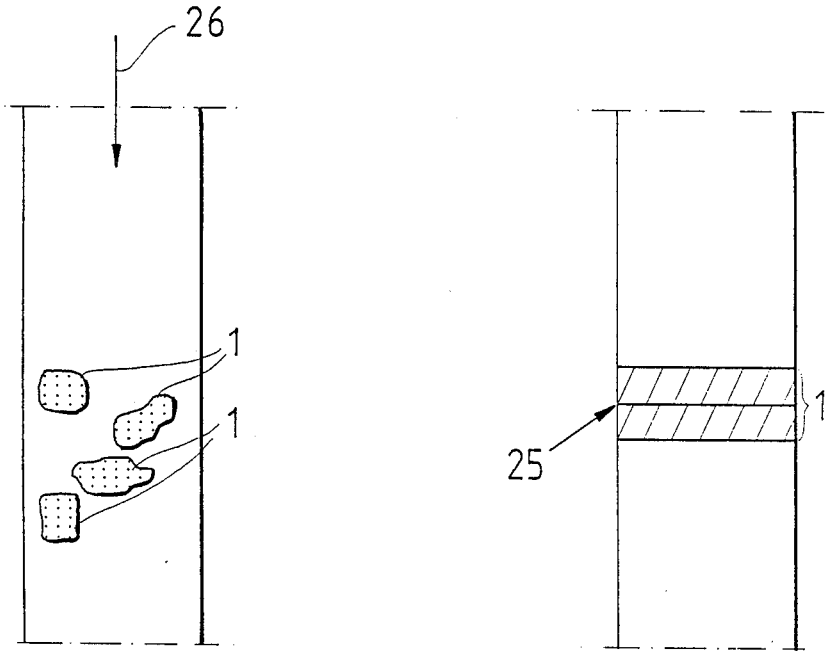
FIG. 8 shows a top view of a stoker with combustion zones and a combustion zone model formed thereof.

In FIG. 8, which especially illustrates the combustion zone 1 of a stoker boiler, the fuel transport direction is indicated by an arrow 26, while the combustion zone 1 and its location are defined as follows:

the image is divided into columns in the transport direction of the fuel, with one of the columns shown in the left part of FIG. 8, the areas and point-of-gravity coordinates obtained for these areas are computed for two intensity level classes of the combustion zones 1, 2 defined above so that, the combustion zone proper is an area found in the column and representing either of the combustion zones by virtue of having a width equal to the column width and a shape corresponding to its actual area, and having the form of a rectangle, which is symmetrically located in respect to its gravity point 25, parallel to the direction of the column.

Effective combustion on the time scale is represented by the median area, computed from the areas of combustion zones identified in subsequent images over a time span of 1 . . . 2 minutes. The movement velocity and direction of the combustion zones is defined from the slope of the regression line computed from temporally subsequent values of gravity points that correspond to the median areas. The stability of combustion is represented by the ratio of the standard deviation of areas to the average values of areas in a series of areas determined from the subsequent images. A low value of oscillation indicates a stable and good combustion process while a large value of oscillation is characteristic of disturbances in combustion. The ratio of combustion indicating areas to the total area correlates with the quality of fuel.

Figure 9:
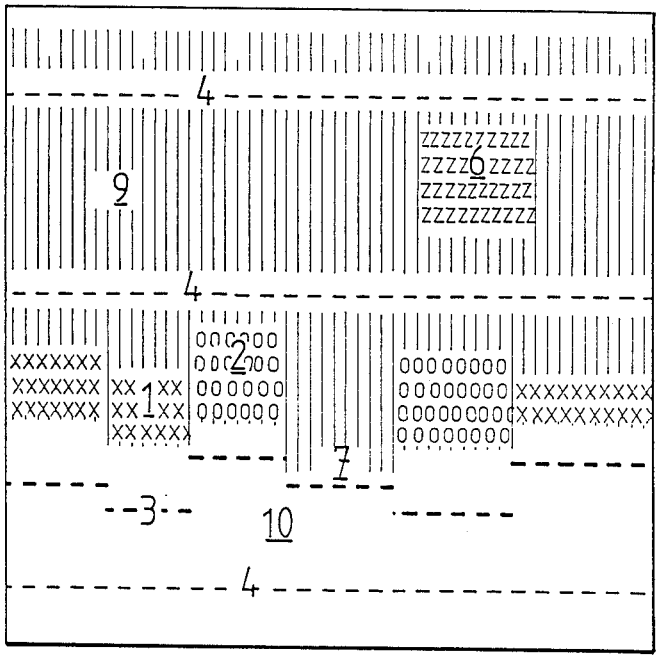
FIG. 9 shows a display screen format compliant with the method in accordance with the present invention.

FIG. 9 shows a method for formatting the characterizing variables of combustion described above in order to display them on a CRT monitor, which is used as a display device in the method according to the invention. Areas 1 are representative of the area of the hottest zone within the column and, consequently, the combustion zone. The gravity point of the zone is located vertically in the mid of the zone. Areas 2 illustrate the combustion zones of the lower intensity level. An area 9 illustrates the fuel zone. An area 6 illustrates a combustion zone external to the actual flame front 14. The edge of the fuel bed has been stopped at a point 7, where firing was latest observed. Bars 3 indicate the extrapolated location of gravity points of combustion areas after a few minutes. A white area 10 represents ash.

The hereinbefore described method can also be applied to soda recovery. The method is excellently applicable to the temperature control of a soda recovery boiler because the temperature differentials involved are in the same order of magnitude. In the soda recovery boiler, the camera can be located in, for instance, a primary or secondary air inlet opening, thus facilitating the monitoring of the soda bed shape. Due to the wavelengths present in a soda recovery boiler, the use of an IR sensitive camera is preferred.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for generating real-time control parameters by means of a video camera for smoke-generating combustion processes with the method based on generating a video signal by means of a video camera;

digitizing the video signal; and filtering the digitized video signal temporarally and spatially;

characterized by the following:

dividing the digitized video signal on the basis of its signal level distribution into signal subareas in order to reduce the quantity of information to be handled;

combining the picture elements belong to the same subarea into contiguous image areas, each of which corresponds to a certain signal level;

combining the subareas into an integrated image;

averaging the subsequent images so as to eliminate the effect of random disturbances; and displaying the average image on a display device.

2. The method as claimed in claim 1 further including the step of controlling a stoker boiler.

3. The method as claimed in claim 1 further including the step of controlling a soda recovery boiler.

4. The method as claimed in claim 1 further including the step of dividing the digitized video signal into subareas so that the characterizing variables of the signal distributions of the video signal are used for defining the signal subareas representing the combustion process.

5. The method as claimed in claim 2 further including the step of dividing the digitized video signal into subareas so that the characterizing variables of the signal distributions of the video signal are used for defining the signal subareas representing the combustion process.

6. The method as claimed in claim 3 further including the step of dividing the digitized video signal into subareas so that the characterizing variables of the signal distributions of the video signal are used for defining the signal subareas representing the combustion process.

* * * * *